United States Patent [19]

Wahls

[11] Patent Number: 4,970,485

[45] Date of Patent: Nov. 13, 1990

[54] SNAP ACTION THERMAL ACTUATOR

[75] Inventor: Karl H. Wahls, Redmond, Wash.

[73] Assignee: Sundstrand Data Control, Inc., Redmond, Wash.

[21] Appl. No.: 273,244

[22] Filed: Nov. 18, 1988

[51] Int. Cl.[5] ..... H01H 37/52

[52] U.S. Cl. ..... 337/335; 337/354; 337/370

[58] Field of Search ..... 337/354, 370, 371, 335, 337/336, 38, 39, 40, 365, 299, 369

[56] References Cited

U.S. PATENT DOCUMENTS 3,014,342 12/1961 Evans ..... 337/370

4,350,967 9/1982 Doherty, Jr. ..... 337/354

*Primary Examiner*—H. Broome

*Attorney, Agent, or Firm*—Michael S. Yatsko; Trevor B. Joike

[57] ABSTRACT

A snap action thermal actuator utilizes a pair of mechanically coupled bimetallic members having different temperature characteristics to provide a fast and positive snap action thermal actuator even when a low temperature differential is required. The actuator is particularly useful for controlling the operation of electrical contacts in a thermal switch.

28 Claims, 1 Drawing Sheet

SNAP ACTION THERMAL ACTUATOR

BACKGROUND

1. Field of the Invention

This invention relates generally to snap action thermal actuators having narrow temperature differentials that are particularly useful for controlling the operation of the electrical contacts of a thermally actuated switch.

2. Prior Art

Thermal actuators for operating the contacts of a thermal switch are known. Typically, such actuators employ a bimetallic member, such as, for example, a disc, that has a high temperature stable state and a low temperature stable state that snaps with a snap action from the low temperature stable state to the high temperature stable state upon heating and returns to the low temperature stable state upon cooling. In such devices, the bimetallic member snaps to its high temperature stable state at a predetermined temperature known as the upper set point and returns to its low temperature stable state at a lower temperature known as the lower set point. The temperature difference between the upper and lower set points is known as the temperature differential. The temperature differential of an actuator may be adjusted to suit the desired application by adjusting the geometry of the bimetallic disc.

When operating the contacts of a thermal switch it is desirable to have a strong snap action to insure a rapid opening and closing of the contacts in order to reduce arcing and contact resistance to thereby prolong the life of the contact. A strong snap action is not difficult to achieve with an actuator employing a bimetallic member as long as the temperature differential of the member is relatively high. However, when the temperature differential is reduced, the quality of the snap action is also reduced and the contacts will be opened and closed more slowly.

One attempt to provide a quick acting temperature controlled electric switch is illustrated in U.S. Pat. No. 1,918,491. The device disclosed in the '491 patent utilizes two bimetallic discs carrying opposed contacts. The two discs have different thermal characteristics and cooperate to maintain pressure on the contacts as the opening temperature is approached. However, the device illustrated in the '491 patent will still have a relatively sluggish snap action when discs having a low temperature differential are used. Also the design is relatively complex, and cannot readily control externally mounted contacts. Consequently, the design cannot easily be integrated into existing switch designs.

SUMMARY OF THE INVENTION

Accordingly, it is an object of the present invention to provide a thermal actuator that overcomes many of the disadvantages of the prior art thermal actuators.

It is another object of the present invention to provide a thermal actuator particularly usable for controlling the operation of a thermally controlled switch.

It is another object of the present invention to provide a thermal actuator that provides rapid snap action even in low temperature differential applications.

It is another object of the present invention to provide a simple positive snap action actuator that can be retrofitted into existing designs.

Thus, in accordance with a preferred embodiment of the invention, two bistable bimetallic members are mechanically coupled together to move in unison. The temperature differential of each individual member is relatively high to assure good snap action, but the upper and lower set points of the two members are different and selected so that one of the members controls the separation of the contacts and the other member controls the closing of the contacts. Thus, by appropriately selecting the set points of the two members, a temperature differential for the combination of the two members that is lower than the temperature differential of either individual member may be obtained.

DESCRIPTION OF THE DRAWING

These and other objects and advantages of the present invention will become readily apparent upon consideration of the following detailed description and attached drawing, wherein.

DETAILED DESCRIPTION

Figure 1:
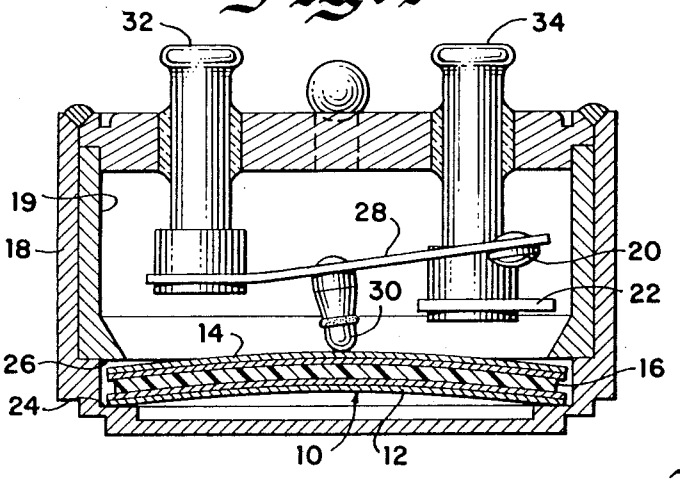
FIG. 1 is a side sectional view of the actuator according to the invention used to control the operation of a switch showing the actuator in its low temperature stable state position.

Referring now to the drawing, with particular attention to FIG. 1, there is shown a thermal actuator according to the invention generally designated by the reference numeral 10. The actuator 10 is shown in the environment of a thermal switch for purposes of illustration, because it is particularly suitable to such applications, but it should be understood that the actuator 10 could be used to actuate other devices. The actuator 10 comprises, in the illustrated embodiment, a pair of bistable bimetallic members, which in the present embodiment, comprise a pair of discs 12 and 14. While the discs 12 and 14 are referred to as bimetallic because they are fabricated from two layers of metal such as Invar (an alloy of iron, nickel, carbon, manganese and silicon that has a low coefficient of expansion) and steel having different coefficients of expansion, they may be fabricated from other materials having different temperature coefficients, whether metallic or non-metallic, and the term bimetallic is intended to encompass any structure utilizing material of different temperature coefficients as a thermal actuator. A third disc 16, fabricated from a flexible, high temperature material is interposed between the discs 12 and 14. One material suitable for the disc 16 is a polyimide film manufactured under the trade name Kapton by DuPont. The thickness of the disc 16 is selected to provide an optimum spacing between the discs 12 and 14 that maximizes the snap action of the actuator. Clearance is provided between the three discs to enhance operation as will be explained below. The discs 12, 14 and 16 are captured within a housing 18 by an inner housing 19 containing a thermal switch having moveable contact 20 that is movable into and out of engagement with fixed contact 22 by the discs 12 and 14. Shoulders 24 and 26 extending from the respective housings 18 and 19 engage the periphery of the discs 12, 14 and 16 and serve to retain the discs 12, 14 and 16 in position. The spacing between the shoulders 24 and 26 is adjusted so that the distance between the shoulders 24 and 26 is approximately 5 mils greater than the combined thickness of the discs 12, 14 and 16 so that the discs 12, 14 and 16 are loosely held in place and the operation enhancing clearance is provided. A resilient member 28 maintains the contacts 20 and 22 closed when the actuator 10 is in its high temperature position (FIG. 2), and the contacts are opened by pressure exerted on the member 28 by the actuator 10 via a striker pin 30 when the actuator 10 reaches its low temperature position (FIG. 1) to open and close a circuit between a pair of terminals 32 and 34.

While the actuator 10 is described in conjunction with a simple mechanical switch, it should be understood that the actuator may be used to operate any suitable device including other switches including solid state switches, devices that modulate the flow of current or otherwise control the operation of an electrical circuit, or even to mechanical controllers such as valves that control a thermally responsive hydraulic or pneumatic control system.

Figure 2:
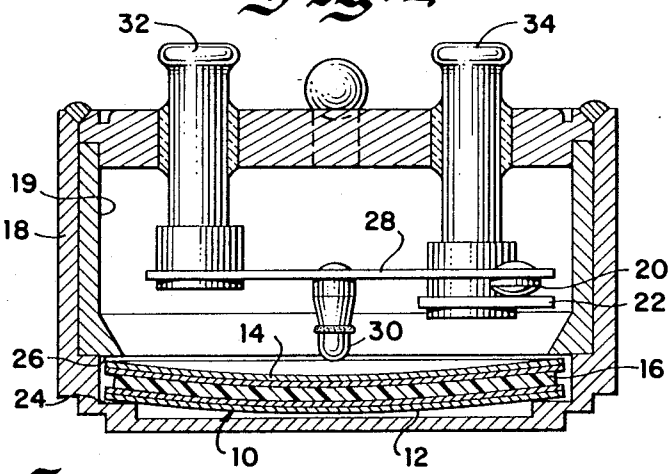
FIG. 2 is a side sectional view similar to FIG. 1 showing the actuator in its high temperature stable state.

Each of the discs 12 and 14 has a high temperature stable state and a low temperature stable state. For example, the low temperature stable state for both discs may be such that each disc has its concave side down at room temperature (FIG. 1), and upon heating to a higher temperature, the disc snaps to its high temperature stable state for example, to a state wherein the concave side of the disc is up (FIG. 2). Upon cooling, the concave side remains up until the disc is cooled sufficiently to reverse to its low temperature stable state.

Figure 3:
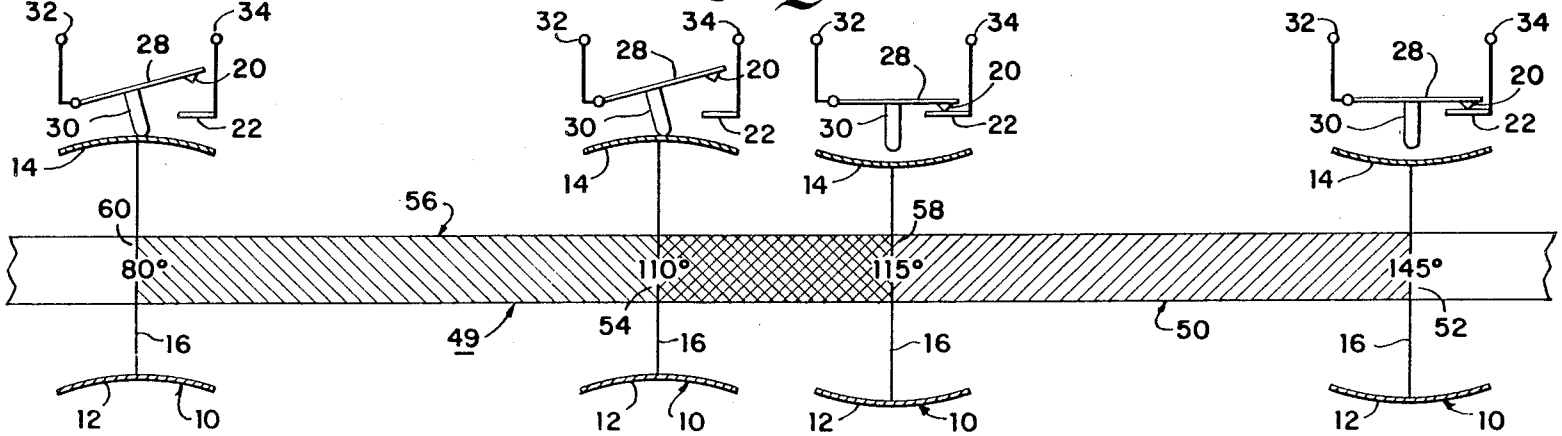
FIG. 3 is a temperature bar graph illustrating the operating principle of the actuator according to the invention.

The thermal characteristics of the discs 12 and 14 are illustrated in FIG. 3. The thermal characteristics of the disc 12 are illustrated by a portion 50 of a bar graph 49 which illustrates an upper set point 52 and a lower set point 54 of the disc 12. Similarly, a portion 56 of the bar graph 49 illustrates the thermal characteristics of the disc 14 and shows an upper set point 58 and a lower set point 60 of the disc 14. The upper and lower set points 52, 54 and 58, 60 of the respective bar graph portions 50 and 56 define the temperatures at which the respective discs 12 and 14 transfer from their low temperature stable state to their high temperature stable state upon heating and to their low temperature stable states upon cooling. For example, at room temperature the disc 12, operating separately, is in its low temperature stable state with its concave side down. Upon heating, the lower side of the disc 12 expands more rapidly than the upper side, thus tending to cause the disc 12 to snap so that its concave side faces upwardly. This snapping action occurs at the upper set point 52. Thus, above the upper set point 52, which corresponds to 145° Fahrenheit for the disc 12, the disc will be in its high temperature stable state with its concave side facing upwardly. Upon cooling, the disc will not revert to its low temperature stable state when the temperature drops below the upper set point 52 (145° Fahrenheit) but will remain in a position corresponding to the high temperature stable position until the lower set point 54, which corresponds to 110° Fahrenheit in the illustrated embodiment, is reached. Below the lower set point 54, the disc 12 will revert to its low temperature stable state.

Below the lower set point 54, the disc 12 will remain in its low temperature stable state, and will resist any mechanical pressure to cause it to change to the high temperature stable state, and upon removal of any such physical pressure, will revert to its low temperature stable state. Similarly, above the upper set point 52, the disc 12 will resist any pressure to cause it to assume the low temperature stable state and will return to the high temperature stable state upon removal of such pressure. However, in the range of temperatures illustrated by the bar graph portion 50 between the upper set point 52 and the lower set point 54, the disc 12 is in a vacillation range wherein it may assume either the high temperature stable state position or the low temperature stable state position. Absent any mechanical pressure, the disc will remain in whatever state it was in when it entered the vacillation range, but the disc can be mechanically moved between the high temperature and lower temperature stable state positions by mechanical pressure and retain the position to which it has been moved. The above description also applies to the operation of the disc 14 except that the temperatures corresponding to the upper and lower set points of the disc 14 are lower than those of the disc 12, as shown by the upper and lower set points 58 and 60 at opposite ends of the bar graph portion 56 that illustrates the vacillation range of the disc 14 (FIG. 3).

As can be seen from the graph of FIG. 3, the temperature difference between the upper and lower set points of each of the discs 12 and 14, is approximately 35° Fahrenheit, i.e. between 110° Fahrenheit and 145° Fahrenheit for the disc 12 and between 80° Fahrenheit and 115° Fahrenheit for the disc 14. The difference in temperature between the upper and lower set points is known as the temperature differential of the disc, and in general, a relatively high temperature differential as the one illustrated in FIG. 3 provides for a strong snap action at the transition between the high and low temperature stable states.

However, in many applications, a temperature differential large enough to assure vigorous snap action is undesirable for other reasons, for example, in applications wherein it is necessary to maintain the temperature within a very narrow range of temperatures. In such an application, a thermal switch having a small temperature differential is required. This is accomplished by the actuator according to the invention by utilizing two bimetallic members having relatively high temperature differentials, but different upper and lower set points. The two bimetallic members have overlapping vacillation ranges and are mechanically coupled together so that when one member changes state it will exert a mechanical pressure on the other member. Because the two members have overlapping vacillation ranges, one will be in its vacillation range when the other changes state. Thus, when one member changes state, it will cause the other member also to change state by applying pressure to it. The previously mentioned spacing between the members permits the member changing state to gain momentum prior to actuating the other member to thereby provide a more positive snap action. For example, in the illustrated embodiment, the thickness of each of the bimetallic discs is 8 mils, the thickness of the Kapton disc is 5 mils and the spacing between the shoulders 24 and 26 is 26 mils to provide the desired spacing. The value of the spacing is determined empirically and may vary as a function of the thermal and mechanical characteristics of the particular discs that are used. Also, as previously mentioned, the thickness of the disc 16 is important in optimizing snap action, and a thickness of 5 mils has been empirically determined to be optimum for use with the aforementioned 8 mil bimetallic discs.

As illustrated, the disc 12 having the higher temperature set points is disposed with its convex side adjacent to the concave side of the disc 14 having the lower temperature set points. A third disc, such as the disc 16, serves to transfer energy between the two discs 12 and 14. With the arrangement shown in FIG. 1, both discs 12 and 14 are in their lower stable state positions with their concave sides facing down. Upon heating, the lower set point 60 of the disc 14 is first encountered. At this point, the disc 14 enters its vacillation range, but the disc 12 is still in its low temperature stable state, and thus no change occurs. Upon further heating, the lower set point 54 of the disc 12 is reached, and at this point, both the discs 12 and 14 are in their vacillation ranges. However, absent any mechanical pressure, no change will occur.

Upon further heating, the upper set point 58 of the disc 14 will be reached. At this point, the disc 14 will change from its low temperature stable state to its high temperature stable state and apply pressure to the disc 12. Because the disc 12 is in its vacillation range, the pressure from the disc 14 will cause it to change position from its low temperature stable state position to its high temperature stable state position, and the assembly will snap to a position corresponding to the high temperature stable state position and actuate the switch. The assembly will remain in the high temperature stable state position until the temperature reaches the lower set point 54 of the disc 12. At this point, the disc 12 will revert to its low temperature stable state position and exert pressure on the disc 14 which is in its vacillation range, and the assembly will return to the low temperature stable state position.

Thus, in the illustrated embodiment, the transition from the low temperature stable state to the high temperature stable state position is determined by the disc 14 and the transition from the high temperature stable state position to the low temperature stable state position is controlled by the disc 12. Consequently, by appropriately selecting the upper and lower set points of the two discs, a small temperature differential (5° in the illustrated embodiment) may be obtained without sacrificing the effectiveness of the snap action switching, because the snap action switching is controlled by the temperature differentials of the individual discs which may be maintained at a high value.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A thermal actuator comprising:

a first bistable bimetallic member having an upper set point defining a high temperature stable state and a lower set point defining a low temperature stable state; and a second bistable bimetallic member having an upper set point defining a high temperature stable state and a lower set point defining a low temperature stable state, the upper set point of said second bistable bimetallic member being between the upper and lower set points of the first bistable bimetallic member and the lower set point of said second bistable bimetallic member being below the lower set point of said first bistable bimetallic member, said first and second bistable bimetallic members being mechanically coupled to form a bistable thermal actuator having a high temperature stable state determined by the upper set point of said second bistable bimetallic member and a low temperature stable state defined by the lower set point of said first bistable bimetallic member.

2. A thermal actuator as recited in claim 1 wherein said bimetallic members are disc shaped.

3. A thermal actuator as recited in claim 1 further including means including a third disc shaped member interposed between said bimetallic disc shaped members for mechanically coupling said disc shaped bimetallic members.

4. A thermal actuator as recited in claim 3 wherein said third disc shaped member is operative to provide a precise spacing between said first and second disc shaped members.

5. A thermal actuator comprising:

a first bistable bimetallic member having an upper set point defining a high temperature stable state and a lower set point defining a low temperature stable state;

a second bistable bimetallic member having an upper set point defining a high temperature stable state and a lower set point defining a low temperature stable state, the upper set point of said second bistable bimetallic member being between the upper and lower set points of the first bistable bimetallic member and the lower set point of said second bistable bimetallic member being below the lower set point of said first bistable bimetallic member, said first and second bistable bimetallic members being mechanically coupled to form a bistable thermal actuator having a high temperature stable state determined by the upper set point of said second bistable bimetallic member and a low temperature stable state defined by the lower set point of said first bistable bimetallic member;

means including a third disc shaped member interposed between said bimetallic disc shaped members for mechanically coupling said disc shaped bimetallic members; and means including a pair of spaced members for loosely supporting said disc shaped members with a clearance between said disc shaped members and said spaced members.

6. A thermal actuator as recited in claim 5 wherein the total spacing between said disc shaped members is on the order of approximately 5 mils.

7. A thermal actuator as recited in claim 6 wherein each of said bimetallic disc shaped members each has a thickness on the order of approximately 8 mils.

8. A thermal actuator as recited in claim 7 wherein said third disc shaped member has a thickness on the order of approximately 5 mils.

9. A thermal actuator as recited in claim 3 wherein said third disc shaped member is fabricated from a high temperature, flexible material.

10. A thermal actuator as recited in claim 9 wherein said material is a polyimide film.

11. A thermal actuator as recited in claim 1 further including means operatively coupled to one of said bimetallic members for controlling the operation of an electric circuit.

12. A thermal actuator comprising:

a first bistable bimetallic member having first temperature characteristics and a predetermined temperature differential; and a second bistable bimetallic member having second temperature characteristics that are different from the first temperature characteristics and a predetermined temperature differential, said first and second bistable bimetallic members being mechanically coupled together to form a bistable thermal actuator having a temperature differential that is less than the temperature differential of said first bistable bimetallic member and less than the temperature differential of said second bistable bimetallic member.

13. A thermal actuator as recited in claim 12 further including means for mechanically coupling said bimetallic members together, wherein said coupling means includes a third, flexible member interposed between said bimetallic members and means for loosely holding the three members together.

14. A thermal actuator as recited in claim 13 wherein said third flexible member is operative to provide a precise spacing between said bimetallic members.

15. A thermal actuator as recited in claim 13 wherein said members are disc shaped.

16. A thermal actuator as recited in claim 13 further including means operatively coupled to one of said bimetallic members for controlling the operation of an electric circuit.

17. A bistable thermal actuator having a high temperature transition point to a high temperature stable state and a low temperature transition point to a low temperature stable state, comprising:

a first bistable bimetallic member having a high temperature stable state above a predetermined high temperature, a low temperature stable state below a predetermined low temperature and a vacillation range of temperatures between said predetermined high and low temperatures;

a second bistable bimetallic member having a high temperature stable state above a predetermined high temperature, a low temperature stable state below a predetermined low temperature and a vacillation range of temperatures between said predetermined high and low temperatures, said vacillation ranges of said first and second bistable bimetallic members encompassing different ranges of temperatures, said first and second bistable bimetallic members being mechanically coupled together to form said bistable thermal actuator, the high temperature transition point of said bistable thermal actuator being determined by the transition of one of said bistable bimetallic elements from its vacillation range to one of its stable states, and the low temperature transition point being determined by the transition of the other of said bistable bimetallic members from its vacillation range to one of its stable states.

18. A thermal actuator as recited in claim 17 further including means for mechanically coupling said bimetallic members together, wherein said coupling means includes a third, flexible member interposed between said bimetallic members and means for loosely holding the three members together.

19. A thermal actuator as recited in claim 17 further including means including a third flexible member interposed between said bimetallic members for maintaining said bimetallic members in a precise spaced relationship.

20. A thermal actuator as recited in claim 18 wherein said members are disc shaped.

21. A thermal actuator as recited in claim 18 further including means operatively coupled to one of said bimetallic members for controlling the operation of an electric circuit.

22. A thermal actuator as recited in claim 17 wherein the high temperature transition point is determined by the transition of one of said bimetallic members to its high temperature stable state and the low temperature stable state is determined by the transition of the other bimetallic member to its low temperature stable state.

23. A thermal actuator comprising:

a first bistable bimetallic member having an upper set point defining a high temperature stable state, a lower set point defining a low temperature stable state and a temperature differential between the upper and lower set points; and a second bistable bimetallic member having an upper set point defining a high temperature stable state, a lower set point defining a low temperature stable state and a temperature differential between the upper and lower set points, the upper and lower set points of said second bistable bimetallic member being below the respective upper and lower set points of said first bistable bimetallic member, said first and second bistable bimetallic members being mechanically coupled together to form a bistable thermal actuator having a temperature differential that is less than the temperature differential of either one of said first and second bistable bimetallic members.

24. A thermal actuator as recited in claim 23 further including means for mechanically coupling said bimetallic elements together, wherein said coupling means includes a third, flexible member interposed between said bimetallic members and means for loosely holding the three members together.

25. A thermal actuator as recited in claim 23 further including means including a third flexible member interposed between said bimetallic members for maintaining said bimetallic members in a precise spaced relationship.

26. A thermal actuator as recited in claim 24 wherein said members are disc shaped.

27. A thermal actuator as recited in claim 24 further including means operatively coupled to one of said bimetallic members for controlling the operation of an electric circuit.

28. A thermally actuated switch comprising:

means for controlling the flow of current therethrough having first and second conditions of operation;

means including a first bimetallic member for changing the condition of operation of said current controlling means from its first condition of operations to its second condition of operation upon heating of said first bimetallic member; and means including a second bimetallic member for changing the condition of operation of said current controlling means from its second condition of operation to its first condition of operation upon cooling of said second bimetallic member, said first and second bimetallic members being mechanically coupled.

* * * * *